US008372574B2

(12) United States Patent
Maehata et al.

(10) Patent No.: US 8,372,574 B2
(45) Date of Patent: Feb. 12, 2013

(54) METHOD OF PRODUCING ELECTROSTATIC LATENT IMAGE DEVELOPING TONER

(75) Inventors: Hideo Maehata, Minamiashigara (JP); Yukihiro Ishii, Minamiashigara (JP); Masaaki Suwabe, Minamiashigara (JP); Tsutomu Kubo, Minamiashigara (JP); Makiko Nakano, Minamiashigara (JP); Kazuhiko Yanagida, Minamiashigara (JP); Yasuo Matsumura, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/252,704

(22) Filed: Oct. 4, 2011

(65) Prior Publication Data

US 2012/0028187 A1 Feb. 2, 2012

Related U.S. Application Data

(62) Division of application No. 11/785,526, filed on Apr. 18, 2007, now abandoned.

(30) Foreign Application Priority Data

Nov. 30, 2006 (JP) ..... 2006-322812

(51) Int. Cl.
*G03G 9/08* (2006.01)

(52) U.S. Cl. ..... 430/137.14

(58) Field of Classification Search ..... 430/137.14
See application file for complete search history.

(56) References Cited

U.S. PATENT DOCUMENTS 3,804,619 A 4/1974 Mammino et al.
4,264,697 A 4/1981 Perez et al.
4,971,879 A 11/1990 Kimura et al.
5,476,741 A 12/1995 Nishikiori et al.
5,877,270 A * 3/1999 Takayama et al. ..... 264/344
6,495,648 B1 12/2002 Inagaki et al.
2002/0034703 A1 3/2002 Yamazaki et al.
2002/0042014 A1 4/2002 Fujino et al.
2003/0003387 A1 1/2003 Xu et al.
2003/0186152 A1* 10/2003 Ohno et al. ..... 430/108.8
2003/0191265 A1* 10/2003 Wang ..... 526/319
2003/0219669 A1 11/2003 Yamashita et al.
2003/0232268 A1 12/2003 Sacripante et al.

(Continued)

FOREIGN PATENT DOCUMENTS

EP 1 454 922 A1 9/2004
JP A-49-091231 8/1974

(Continued)

OTHER PUBLICATIONS

CRC Handbook of Chemistry and Physics, 92nd Edition, Internet Version 2012.*

(Continued)

*Primary Examiner* — Peter Vajda
(74) *Attorney, Agent, or Firm* — Oliff & Berridge, PLC

(57) ABSTRACT

A method of producing an electrostatic latent image developing toner includes: preparing a resin particle dispersion by polymerizing, in a water-based solvent, a polymerizable monomer that comprises a polymerizable monomer comprising a vinyl-based double bond; extracting a liquid from the resin particle dispersion by heating; mixing the distilled resin particle dispersion with a colorant particle dispersion prepared by dispersing a colorant; and aggregating the resin particles, the pigment particles and a release agent particles to form aggregate particles, and then conducting heating to fuse the aggregate particles.

15 Claims, 1 Drawing Sheet

Z1 AND Z2 SPATIAL COORDINATES FOR COMPARATIVE EXAMPLE AND EXAMPLES

U.S. PATENT DOCUMENTS

| | | | | |
|---|---|---|---|---|
| 2004/0191656 | A1* | 9/2004 | Ishiyama et al. | 430/106.1 |
| 2004/0191662 | A1 | 9/2004 | Matsumura et al. | |
| 2005/0048392 | A1 | 3/2005 | Tanaka | |
| 2005/0250032 | A1 | 11/2005 | Tokarski et al. | |
| 2007/0009822 | A1 | 1/2007 | Iijima et al. | |
| 2008/0213683 | A1 | 9/2008 | Ota et al. | |

FOREIGN PATENT DOCUMENTS

| | | |
|---|---|---|
| JP | A-56-011461 | 2/1981 |
| JP | A-56-040868 | 4/1981 |
| JP | A-62-039879 | 2/1987 |
| JP | A-64-70765 | 3/1989 |
| JP | A-7-104514 | 4/1995 |
| JP | A-11-133663 | 5/1999 |
| JP | A-2000-172010 | 6/2000 |
| JP | A-2002-040709 | 2/2002 |
| JP | A-2002-040711 | 2/2002 |
| JP | A-2002-99115 | 4/2002 |
| JP | A-2002-162782 | 6/2002 |
| JP | A-2003-057865 | 2/2003 |
| JP | A-2003-173042 | 6/2003 |
| JP | A-2003-202703 | 7/2003 |
| JP | A-2004-287114 | 10/2004 |
| JP | A-2005-202183 | 7/2005 |
| JP | A-2006-48032 | 2/2006 |
| JP | A-2006-145889 | 6/2006 |
| WO | WO 2006/046700 A1 | 5/2006 |

OTHER PUBLICATIONS

Lance et al.; "A General Theory of Classificatory Sorting Strategies: 1. Hierarchical Systems;" Computer Journal; vol. 9; pp. 373-380; (1967).

Milligan; "An Examination of the Effect of Six Types of Error Perturbation on Fifteen Clustering Algorithms;" *Psychometrika*; vol. 45, No. 3; pp. 325-342; Sep. 1980.

Press et al.; "Choosing Between Logistic Regression and Discriminant Analysis;" Journal of the American Statistical Association; vol. 73; pp. 699-705; Dec. 1978.

Seko et al.; "IV-4 Outgassing Analysis of Polymer Materials Using Thermal Desorption Method;" *Abstract of Polymer Analysis and Characterization*; pp. 129-130 (2003). (with translation).

Seko et al.; "Analysis of Volatile Components in Polymer Industrial Materials Using Headspace Method: MHE Method and Standard Addition Method;" *Abstract of Lectures in 49Annual Meeting of Japan Society for Analytical Chemistry*; pp. 1-8 (2000). (with translation).

Nov. 24, 2010 European Search Report issued in EP 07 10 7261.5.

Jan. 25, 2011 Japanese Office Action issued in Japanese Patent Application No. 2006-322012 (with translation).

* cited by examiner

Z1 AND Z2 SPATIAL COORDINATES FOR COMPARATIVE EXAMPLE AND EXAMPLES
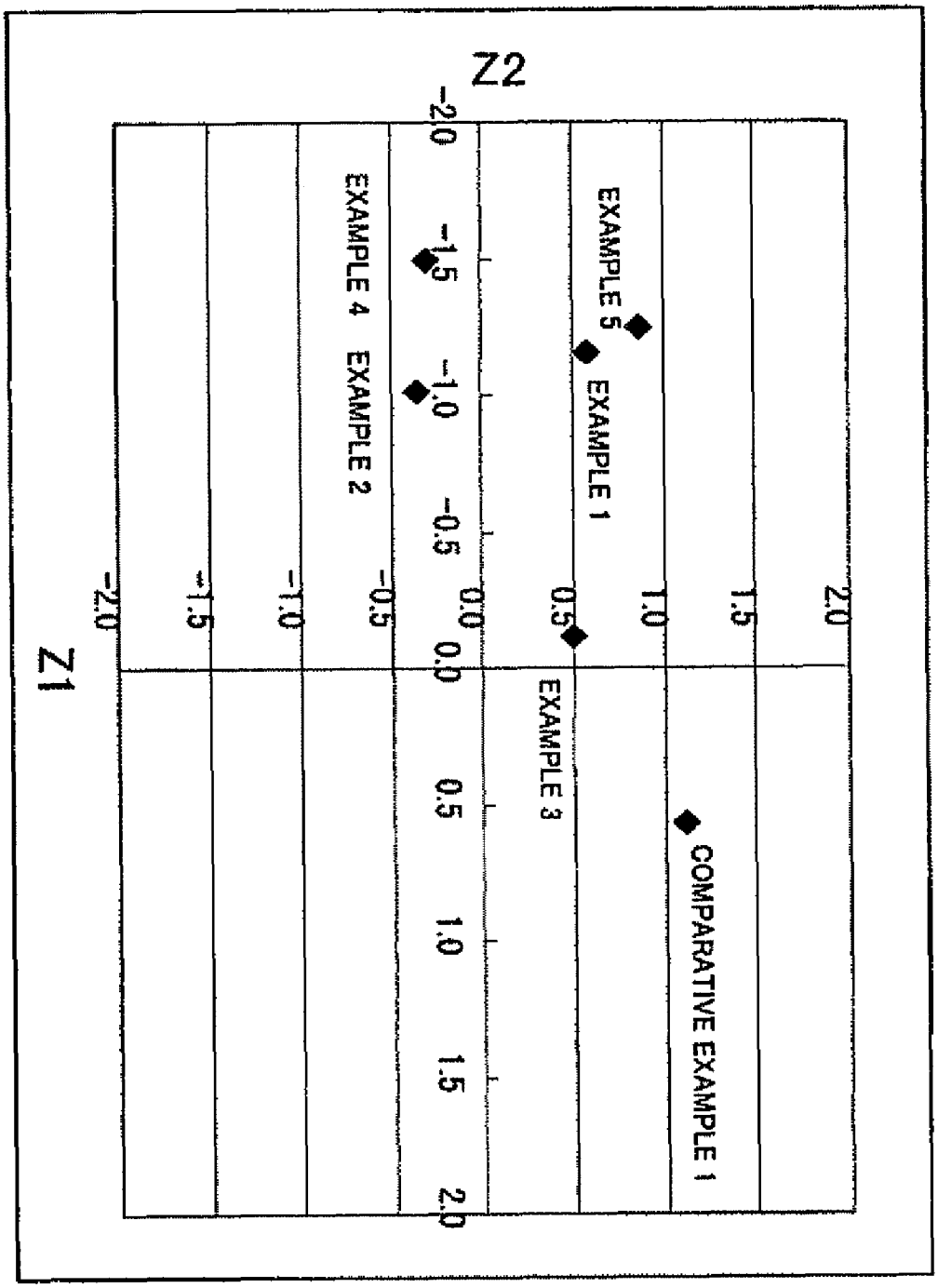

METHOD OF PRODUCING ELECTROSTATIC LATENT IMAGE DEVELOPING TONER

This is a Division of application Ser. No. 11/785,526 filed Apr. 18, 2007, which claims priority to Japanese Patent Application No. 2006-322812 filed Nov. 30, 2006. The disclosure of the prior applications is hereby incorporated by reference herein in their entirety.

CROSS-REFERENCE TO RELATED APPLICATIONS

This application is based on and claims priority under 35 USC 119 from Japanese Patent Application No. 2006-322812, filed on Nov. 30, 2006.

BACKGROUND

1. Technical Field

The present invention relates to an electrostatic latent image developing toner (hereafter also referred to as an electrophotographic toner) and methods of producing such a toner. The invention also relates to electrostatic latent image developers obtained using these production methods.

2. Related Art

In recent years, in the field of electrophotographic toner production, the desire to reduce environmental impact, as typified by LOHAS, has lead to increased demands for greater energy conservation, in addition to the more conventional demands for improvements in image quality and higher productivity.

In order to satisfy demands for these types of electrophotographic toners, conventional mix-and-grind methods, in which the resin is subjected to melt mixing at a high temperature of at least 100° C. before undergoing grinding and classification, are gradually being replaced by chemical production methods such as emulsion polymerization aggregation methods and suspension polymerization methods, in which toner production is conducted at a temperature no higher than 100° C., and which enable more precise control of the toner powder properties such as the toner particle size and structure than conventional mix-and-grind methods.

However, these chemical production methods yield toners in which the quantity of residual volatile organic compounds is considerably higher than in toners produced by conventional mix-and-grind methods, meaning that after extended use, or in high-speed electrophotographic systems that require high-temperature fixation, contamination inside the machine caused by these volatile organic compounds can lead to a variety of problems, including deterioration in the system quality, shortening of the system lifespan, reduction in the recyclability of various components, and odors caused by diffusion of these volatile materials into the atmosphere outside the machine, and these problems are the focus of considerable attention. The odor problem becomes particularly noticeable in smaller offices, such as cases where high-speed copying or printing is conducted in a SOHO environment. The odors that are generated diffuse through the atmosphere, and are detected as an offensive odor upon exceeding the odor threshold. From an ergonomic viewpoint, acceptable levels for these offensive odors are evaluated on the basis of statistical analyses of factors such as physiological aversion (irritation and offensiveness) and reduction in work efficiency.

SUMMARY

The aforementioned VOC machine contamination and odor problems occurring within electrophotographic processes are evaluated by conducting quantitative analyses of the VOC components generated during the operation of low-speed through to high-speed machines, and by conducting panelist testing (sensory evaluations using randomly selected male and female panelists) of the odors associated with the various VOC components detected from the various machines, the odors associated with actual machine contamination, and the odors generated during actual machine operation. The results of these panelist tests and the quantities detected for each of the VOC components are then analyzed statistically using a multivariate analysis technique (the PLS method) to determine the causal relationship between the various problems and the VOC components. As a result of these analyses, it was discovered that by using toners and developers that satisfy the requirements described below, the problems outlined above could be largely suppressed. In other words, the present invention is as described below.

According to an aspect of the invention, there is provided an electrostatic latent image developing toner, for which if the surface area values for 1-butanol, ethylbenzene, n-butyl ether, styrene, butyl propionate, cumene, benzaldehyde and propylbenzene obtained from gas chromatographic analysis of the volatile gas components generated upon heating the toner are termed, a, b, c, d, e, f, g and h respectively, then Z1 and Z2 satisfy the formulas 1 shown below:

$$Z1 = 5.2\times10^{-6}a + 9.6\times10^{-7}b + 2.7\times10^{-6}c - 2.5\times10^{-6}d + 8.7\times10^{-6}e + 1.5\times10^{-7}f + 1.1\times10^{-6}g + 8.3\times10^{-7}h - 1.81 \quad \text{(Formulas 1)}$$

$$Z2 = -6.9\times10^{-6}a + 4.6\times10^{-6}b - 3.9\times10^{-7}c + 2.5\times10^{-6}d - 2.1\times10^{-5}e + 2.3\times10^{-7}f - 6.8\times10^{-7}g + 1.2\times10^{-6}h - 1.82$$

$$Z1 \le 0, \text{ and } Z2 \le 0.9$$

BRIEF DESCRIPTION OF THE DRAWINGS

Exemplary embodiments of the present invention will be described in detail based on the following FIGURE, wherein:

FIG. 1 is a diagram showing a plot of the spatial coordinates relating to odorous components for a comparative example and examples of the present invention, thereby describing the correlation for a variety of odorous components.

DETAILED DESCRIPTION

An electrostatic latent image developing toner according to an exemplary embodiment of the present invention and a method of producing such a toner can be applied to wet production method toners typically known as chemically produced toners, and may also be applied to mix-and-grind methods in some cases, but are particularly suited to wet production methods. A wet production method toner (chemically produced toner) refers to a toner produced by an emulsion polymerization aggregation method, a suspension polymerization method or a melt suspension method or the like, wherein a resin and monomer components are emulsified or dispersed within a water-based medium, and then subjected to polymerization where necessary. Of these methods, the present invention is particularly useful in those cases where a resin component produced by polymerization of a vinyl-based monomer is used as a structural component of the toner.

For the toners produced using each of the production methods, a predetermined quantity of the toner is heated at 130° C. for a fixed period of time, the thus generated mixed VOC gas is separated and quantified using gas chromatography (a GCMS method), the structural components of the mixed gas and the respective quantities thereof are used to determine the positioning of the mixed VOC gas in a two-dimensional space using a multivariate analysis technique, and the quantified two-dimensional spatial coordinates are then determined for the mixed VOC gas (see K. Joreskog, Factor Analysis by Least Squares and Maximum Likelihood Methods, John Wiley & Sons (1977), G. N. Lance and W. T. Williams, Computer Journal, 9, 373 (1967), G. W. Milligan, Psychometrika, 45, 325 (1980), and S.J. Press, Journal of the American Statistical Association 73, 699 (1978)). Moreover, for each of the toners used in the above analyses, a machine using the toner is subjected to continuous operation in a measured environment chamber that is unventilated and held at a constant temperature and humidity, and the odor generated by the machine is evaluated by a group of male and female panelists (an odor sensory evaluation conducted by at least 30 randomly selected men and women) for odor strength and unpleasantness and the like. When the results of these evaluations are correlated with the spatial positioning of the mixed VOC gas it is clear that dramatic improvements in the odor level can be made by reducing the quantities of 1-butanol, ethylbenzene, n-butyl ether, styrene, butyl propionate, cumene, benzaldehyde and propylbenzene, and this discovery gave rise to the present invention.

The results of the above sensory tests and all of the detected VOC components are subjected to statistical processing using a multivariate analysis technique (a PLS method), and investigation of the causal relationship between each of the above problems and each VOC component yields the formulas 1 shown below. Principal component analysis (PCA) is a technique in which the characteristic features of multivariate data are expressed using markers known as principal components. By conducting principal component analysis, an understanding of the relationships between data and the correlation between variables can be gained.

The aforementioned PLS (Partial Least Squares) method is an extension of the above PCA, and is a multivariate regression technique that enables the formulation of a highly predictive linear model. In the PLS method, an explanatory variable X is not simply used for regression analysis, but rather a principal component t that represents a linear coupling of explanatory variables is subjected to optimization modeling using the PLS method. In the PLS method, a model can be formulated even in those cases where the number of explanatory variables exceeds the number of samples. Moreover, because the PLS method does not include inverse matrix calculations, the collinearity problem does not arise. Furthermore, because information for the explanatory variables is used in sequence via the principal components, predictability can be investigated while changing the degree of freedom of the PLS model. Accordingly, in an exemplary embodiment of the present invention, this PLS method is used to formulate a correlation model between the sensory evaluations and the VOC principal components.

The PLS method is a method in which a linear model Y=f(X) is established between an variable X and an response variable Y. In this exemplary embodiment, as the response variables Y, the odorous components are separated into two principal component groups, with the first principal component including 1-butanol, n-butyl ether, styrene, butyl propionate, cumene, benzaldehyde and propylbenzene, and the second primary component being ethylbenzene. In the present invention, when the values of these two objective variables are correlated with the results of the panelist sensory tests (odor sensory evaluations conducted by at least 30 randomly selected men and women), it is evident that by suppressing the values of these objective variables to no more than certain values, the results of the sensory evaluations can be improved dramatically.

In other words, if the surface area values for each of the VOC components, namely 1-butanol, ethylbenzene, n-butyl ether, styrene, butyl propionate, cumene, benzaldehyde and propylbenzene, within the gas chromatography spectrum are termed, a, b, c, d, e, f, g and h respectively, then by ensuring the values of Z1 and Z2 defined below satisfy a single formula, sensory evaluation results are obtained from the panelists that indicate a low odor toner. That is, in the formulas 1 shown below, if Z1>0 and/or Z2>0.9, then a satisfactory improvement in the odor level cannot be achieved.

$$Z1 = 5.2\times10^{-6}a + 9.6\times10^{-7}b + 2.7\times10^{-6}c - 2.5\times10^{-6}d + 8.7\times10^{-6}e + 1.5\times10^{-7}f + 1.1\times10^{-6}g + 8.3\times10^{-7}h - 1.81 \quad \text{(Formulas 1)}$$

$$Z2 = -6.9\times10^{-6}a + 4.6\times10^{-6}b - 3.9\times10^{-7}c + 2.5\times10^{-6}d - 2.1\times10^{-5}e + 2.3\times10^{-7}f - 6.8\times10^{-7}g + 1.2\times10^{-6}h - 1.82$$

$$Z1 \le 0, \text{ and } Z2 \le 0.9$$

When determining the surface area values for each of the components, toluene is used as a standard material, and a surface area measurement is conducted for a toluene sample in a state of vapor-liquid equilibrium obtained by heating a saturated aqueous solution of toluene for 90 minutes at 60° C. (a MHE method: The Japan Society for Analytical Chemistry, Proceedings of the 49th annual conference, p. 40 (2000), Proceedings of the 8th Polymer Analysis & Characterization Conference, p. 129 (2003)). From the result of this measurement, the toluene quantity per unit of surface area is calculated, and a surface area correction is then applied for each measurement to ensure that this value is $2.5\times10^{-12}$ g, meaning any physical errors during measurement must be corrected against this $2.5\times10^{-12}$ standard value. Accordingly, when measuring a toner sample, the toluene quantity from a toluene aqueous solution must first be measured, and the surface area value for each sample must then be corrected for measurement error using the formula shown below (formula 2) (yielding a corrected surface area value) in order to ensure satisfactory accuracy.

Corrected surface area value for each sample=(surface area value for sample)/{(toluene quantity per unit of surface area)/$2.5\times10^{-12}$} (Formula 2)

A method of producing an electrostatic latent image developing toner according to an exemplary embodiment includes: preparing a resin particle dispersion by polymerizing, in a water-based solvent, a polymerizable monomer that includes a polymerizable monomer having a vinyl-based double bond; distilling the resin particle dispersion; and mixing the distilled resin particle dispersion with at least a colorant particle dispersion prepared by dispersing a colorant, and in some cases with a release agent particle dispersion prepared by dispersing a release agent, aggregating the resin particles, the pigment particles and the release agent particles to form aggregate particles, and then conducting heating to fuse the aggregate particles.

In order to produce a toner in which the values of the aforementioned Z1 and Z2 satisfy the formulas 1, distilling off the VOC components (a stripping operation) with the toner resin particle dispersion or the toner particles emulsified or dispersed within water is very effective, and this process is particularly effective when the toner particle size is at the sub-micron level.

Any of the various techniques used industrially can be used for conducting the stripping operation, and suitable techniques include blowing a gas such as nitrogen or air through the heated emulsion or dispersion, heating under reduced pressure, or combinations of these techniques. Moreover, in addition to these techniques, regulation of the pH of the water-based medium can also be used to promote the diffusion of VOC components from inside the particles into the medium, and to reduce the occurrence of aggregates during the stripping operation. In such cases, the pH is preferably adjusted to a value of 3 or greater, and pH values of 4 or greater are particularly effective.

In those cases where an aforementioned stripping method is used, the flow rate of the gas blown into the system is typically within a range from 40 to 600 L/min/$m^2$, and values from 100 to 400 L/min/$m^2$ are particularly desirable.

Furthermore, in those cases where reduced pressure distillation or reduced pressure stripping is used, by controlling the degree of pressure reduction to a value within a range from the vapor pressure of water at that particular treatment temperature to a value 20 kPa higher than that vapor pressure of water, the odorous components can be removed effectively without altering the characteristics of the resin particles within the resin particle dispersion.

As mentioned above, the method of producing a toner according to an exemplary embodiment of the present invention can be applied to chemically produced toners produced by emulsion aggregation methods or suspension polymerization methods or the like, and to toners produced by mix-and-grind methods. However, the method of the present invention is particularly applicable to chemically produced toners, and especially to so-called emulsion polymerization methods, in which a toner resin is polymerized, either by subjecting an unsaturated monomer containing a radical polymerizable vinyl group to emulsion polymerization, or by forming a stable emulsion of a resin component prepared by polymerization using polyaddition or polycondensation and an aforementioned vinyl group-containing monomer, and subsequently conducting a mini-emulsion polymerization. The toner particles, which include a pigment and a wax and the like, are then subjected to aggregation and heat fusion.

Examples of the monomer containing a radical polymerizable vinyl group include aromatic vinyl monomers, (meth) acrylate ester monomers, vinyl ester monomers, vinyl ether monomers, monoolefin monomers, diolefin monomers, and halogenated olefin monomers. Specific examples of suitable aromatic vinyl monomers include styrene monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene. Specific examples of suitable (meth)acrylate ester monomers include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, and diethylaminoethyl methacrylate. Specific examples of suitable vinyl ester monomers include vinyl acetate, vinyl propionate and vinyl benzoate. Specific examples of suitable vinyl ether monomers include vinyl methyl ether, vinyl ethyl ether, vinyl isobutyl ether and vinyl phenyl ether. Specific examples of suitable monoolefin monomers include ethylene, propylene, isobutylene, 1-butene, 1-pentene, and 4-methyl-1-pentene. Specific examples of suitable diolefin monomers include butadiene, isoprene and chloroprene. Specific examples of suitable halogenated olefin monomers include vinyl chloride, vinylidene chloride and vinyl bromide. The above list is no way limiting, and the monomer may use either a single monomer or a combination of two or more different monomers.

Moreover, the polymerization of the above monomers may be performed using conventional polymerization methods such as emulsion polymerization methods, mini-emulsion methods, suspension polymerization methods and dispersion polymerization methods, and may include other components such as initiators, emulsifiers and stabilizers, so that the polymerization itself in no way restricts the present invention.

In the aggregation process for the emulsion or dispersion of these resin particles, the aforementioned resin particle dispersion is mixed in a water-based medium, together with a colorant particle dispersion and a release agent dispersion where required, a coagulant is added, and the particles are subjected to hetero-aggregation, thereby enabling formation of aggregated particles of particle size. Furthermore, following aggregation in this manner to form primary aggregate particles, a dispersion of fine particles of a different polymer may be added, enabling formation of a secondary shell layer on the surface of the primary particles. In this example, the colorant dispersion is prepared separately, but in those cases where the colorant is added in advance to the resin particles, the use of a separate colorant dispersion is unnecessary.

Subsequently, in the fusion process, the resin particles are heated to a temperature at least as high as the glass transition temperature or melting temperature of the resin that constitutes the resin particles, thereby fusing the aggregate particles, and the fused particles are then washed if necessary and dried to yield the toner particles. The shape of the toner particles may be any shape from amorphous particles through to spherical particles. Examples of preferred coagulants include not only surfactants, but also inorganic salts and bivalent or higher metal salts. The use of metal salts is particularly preferred in terms of factors such as controlling the aggregation properties and achieving favorable toner chargeability.

As follows is a description of the components used in forming the toner.

Specific examples of suitable colorants include carbon blacks such as furnace black, channel black, acetylene black and thermal black; inorganic pigments such as red iron oxide, iron blue and titanium oxide; azo pigments such as fast yellow, disazo yellow, pyrazolone red, chelate red, brilliant carmine and para brown; phthalocyanine pigments such as copper phthalocyanine and metal-free phthalocyanine; and condensed polycyclic pigments such as flavanthrone yellow, dibromoanthrone orange, perylene red, quinacridone red and dioxazine violet. Further examples include various pigments such as chrome yellow, hansa yellow, benzidine yellow, threne yellow, quinoline yellow, permanent orange GTR, pyrazolone orange, vulkan orange, watchung red, permanent red, DuPont oil red, lithol red, rhodamine B lake, lake red C, rose bengal, aniline blue, ultramarine blue, calco oil blue, methylene blue chloride, phthalocyanine blue, phthalocyanine green, malachite green oxalate, C.I. Pigment Red 48:1, C.I. Pigment Red 122, C.I. Pigment Red 57:1, C.I. Pigment Yellow 12, C.I. Pigment Yellow 97, C.I. Pigment Yellow 17, C.I. Pigment Blue 15:1 and C.I. Pigment Blue 15:3, and these colorants may be used either alone, or in combinations of two or more different colorants.

Specific examples of suitable release agents include natural waxes such as such as carnauba wax, rice wax and candelilla wax; synthetic, mineral or petroleum waxes such as low molecular weight polypropylene, low molecular weight polyethylene, sasol wax, microcrystalline wax and Fischer-Tropsch wax; and ester waxes such as fatty acid esters and montanate esters, although this is not a restrictive list. These release agents may be used either alone, or in combinations of two or more different materials. From the viewpoint of storage stability, the melting temperature of the release agent is preferably at least 50° C., and is even more preferably 60° C. or higher. Furthermore, from the viewpoint of offset resistance, the melting point is preferably no higher than 110° C., and is even more preferably 100° C. or lower.

In addition, various other components may also be added according to need, including internal additives, charge control agents, inorganic powders (inorganic particles) and organic particles. Examples of suitable internal additives include magnetic materials such as ferrite, magnetite, metals such as reduced iron, cobalt, nickel or manganese, and alloys or compounds containing these metals. Examples of suitable charge control agents include quaternary ammonium salt compounds, nigrosine compounds, dyes formed from complexes of aluminum, iron or chromium, and triphenylmethane-based pigments. Furthermore, inorganic powders are typically added for the purpose of regulating the toner viscoelasticity, and suitable examples include inorganic fine particles of silica, alumina, titania, calcium carbonate, magnesium carbonate, calcium phosphate and cerium oxide, which are typically used as external additives on the toner surface, as described in detail below.

A toner obtained using the method of producing an electrostatic latent image developing toner according to the present invention described above is used as an electrostatic latent image developer. There are no particular restrictions on this developer, other than the requirement to include the above electrostatic latent image developing toner, and other components may be added in accordance with the intended purpose of the developer. In those cases where the electrostatic latent image developing toner is used alone, the developer is prepared as a one-component electrostatic latent image developer, whereas when the toner is used in combination with a carrier, the developer is prepared as a two-component electrostatic latent image developer.

There are no particular restrictions on the carrier, and conventional carriers can be used, including the resin-coated carriers disclosed in JP 62-39879 A and JP 56-11461 A.

Specific examples of suitable carriers include the resin-coated carriers listed below. Namely, examples of suitable core particle for these carriers include typical iron powder, ferrite and magnetite structures, and the volume average particle size of these core particles is typically within a range from approximately 30 to 200 μm. Examples of the coating resin for these core particles include copolymers of styrenes such as styrene, para-chlorostyrene and α-methylstyrene, α-methylene fatty acid monocarboxylates such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acrylate compounds such as dimethylaminoethyl methacrylate; vinylnitriles such as acrylonitrile and methacrylonitrile; vinylpyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; silicones such as methylsilicone and methylphenylsilicone; and vinyl-based fluorine-containing monomers such as vinylidene fluoride, tetrafluoroethylene and hexafluoroethylene; as well as polyesters containing bisphenol or glycol, epoxy resins, polyurethane resins, polyamide resins, cellulose resins, and polyether resins. These resins may be used either alone or in combinations of two or more different resins. The quantity of the coating resin is preferably within a range from approximately 0.1 to 10 parts by weight, and even more preferably from 0.5 to 3.0 parts by weight, per 100 parts by weight of the carrier. Production of the carrier can be conducted using a heated kneader, a heated Henschel mixer or a UM mixer or the like. Depending on the quantity of the coating resin, a heated fluidized rolling bed or heated kiln or the like may also be used.

In the electrostatic latent image developer, there are no particular restrictions on the mixing ratio between the electrostatic latent image developing toner and the carrier, which may be selected appropriately in accordance with the intended application.

Furthermore, the electrostatic latent image developer (the electrostatic latent image developing toner) can be used within a typical image forming method that uses an electrostatic latent image developing system (an electrophotographic system). Specifically, an image forming method of the present invention includes an electrostatic latent image formation step, a toner image formation step, a transfer step, and a cleaning step. Each of these steps can use conventional processes, such as those disclosed in JP 56-40868 A and JP 49-91231 A. Furthermore, an image forming method of the present invention can be conducted using a conventional image forming apparatus such as a conventional copying machine or facsimile or the like. The above electrostatic latent image formation step involves forming an electrostatic latent image on an electrostatic latent image support. The toner image formation step involves developing the electrostatic latent image using a developer layer on a developer support, thereby forming a toner image. There are no particular restrictions on the developer layer, provided it incorporates an electrostatic latent image developer of the present invention that contains an electrostatic latent image developing toner of the present invention. The transfer step involves transferring the toner image to a transfer target body. The cleaning step involves removing any residual electrostatic latent image developer from the surface of the electrostatic latent image support. An image forming method of the present invention preferably also includes a recycling step. This recycling step involves moving the electrostatic latent image developing toner recovered in the above cleaning step to the developer layer. An image forming method that includes a recycling step can be executed using an image forming apparatus such as a copying machine or facsimile that is equipped with a toner recycling system. Furthermore, the image forming method can also be applied to a recycling system that has no cleaning step, but rather recovers the toner at the same time as the developing process.

EXAMPLES

As follows is a description of a specific comparative example and examples according to the present invention, although the scope of the present invention is in no way limited by these examples. In the following description, unless stated otherwise, the units "parts" refer to "parts by weight".

[Evaluation Methods and Measurement Methods]

(Method of Measuring Particle Size and Particle Size Distribution)

As follows is a description of the measurement of particle size and particle size distribution within the present invention. In those cases where the particle size to be measured is 2 μm or greater, measurement is conducted using a Coulter Multisizer-II (manufactured by Beckman Coulter, Inc.), using Isoton-II (manufactured by Beckman Coulter, Inc.) as the electrolyte.

The measurement method involves adding from 0.5 to 50 mg of the measurement sample to a surfactant as the dispersant (2 ml of a 5% aqueous solution of a sodium alkylbenzenesulfonate is preferred), and then adding this sample to 100 to 150 ml of the above electrolyte.

The electrolyte containing the suspended sample is subjected to dispersion treatment for approximately one minute in an ultrasound disperser, and then using the aforementioned Coulter Multisizer-II, the particle size distribution is measured for particles from 2 to 60 μm using an aperture size of 100 μm, and the volume average particle distribution and the number average particle distribution are then determined. The number of particles measured is 50,000.

Furthermore, the toner particle size distribution in the present invention is determined in the following manner. Namely, the previously measured particle size distribution is divided into particle size ranges (channels), and a volume cumulative distribution curve is drawn beginning at the smaller particle sizes. On this curve, the volume average particle size at the point where the accumulated volume reaches 16% is defined as D16, and the volume average particle size at the point where the accumulated volume reaches 50% is defined as D50. Similarly, the volume average particle size at the point where the accumulated volume reaches 84% is defined as D84.

In the present invention, the volume average particle size refers to D50, and the GSD value is calculated using the formula shown below.

$$GSD=(D84/D16)^{0.5}$$

In a similar manner, the previously measured particle size distribution is divided into particle size ranges (channels), a particle number cumulative distribution curve is drawn beginning at the smaller particle sizes, and the particle size at which the accumulated value reaches 50% is defined as the number average particle size.

In those cases where the particle size to be measured in the present invention is less than 2 μm, measurement is conducted using a laser diffraction particle size distribution analyzer (LA-700, manufactured by Horiba, Ltd.). The measurement method involves adjusting the dispersion-state sample so that the solid fraction of the sample is approximately 2 g, and then adding ion-exchanged water to make the sample up to approximately 40 ml. This sample is then added to the cell in sufficient quantity to generate a suitable concentration, the sample is then left to stand for approximately 2 minutes until the concentration within the cell has substantially stabilized, and the measurement is then conducted. The volume average particle size for each of the obtained channels is accumulated beginning at the smaller volume average particle sizes, and the point where the accumulated volume reaches 50% is defined as the volume average particle size.

(Method of Measuring Toner Weight Average Molecular Weight)

Measurement of the weight average molecular weight of the electrostatic latent image developing toner of the present invention is conducted under the following conditions. Namely, GPC is conducted using devices HLC-8120GPC and SC-8020 (manufactured by Tosoh Corporation), two columns (TSKgel, Super HM-H, manufactured by Tosoh Corporation, 6.0 mmID×15 cm), and using THF (tetrahydrofuran) as the eluent. Testing is conducted under conditions including a sample concentration of 0.5%, a flow rate of 0.6 ml/minute, a sample injection volume of 10 μl, and a measurement temperature of 40° C., using an IR detector. Furthermore, the calibration curve is prepared using 10 polystyrene TSK standards manufactured by Tosoh Corporation: A-500, F-1, F-10, F-80, F-380, A-2500, F-4, F-40, F-128 and F-700.

(Method of Measuring Toner Glass Transition Temperature)

The melting temperature and glass transition temperature of the toner of the present invention are determined from the subjective maximum peak, measured in accordance with ASTM D3418-8.

Measurement of the subjective maximum peak can be conducted using a DSC-7 manufactured by PerkinElmer Inc. In this device, temperature correction at the detection portion is conducted using the melting temperatures of indium and zinc, and correction of the heat quantity is conducted using the heat of fusion of indium. The sample is placed in an aluminum pan, and using an empty pan as a control, measurement is conducted at a rate of temperature increase of $10^2$C/minute.

[Toner Production Examples]

(Preparation of Resin Particle Dispersion 1)

A reactor fitted with a reflux condenser, a stirrer, a nitrogen inlet and a monomer dropping funnel is charged with 3,460 parts of ion-exchanged water, 3.3 parts of sodium dodecylbenzenesulfonate is dissolved in the water, 30.6 parts of styrene, 9.4 parts of butyl acrylate, 1.2 parts of acrylic acid dimer and 0.3 parts dodecanethiol are added to the solution, and stirring is conducted at room temperature to achieve a stable emulsion (the emulsion 1). Moreover, a separate vessel fitted with a stirrer is charged with 3,000 parts of styrene, 940 parts of butyl acrylate, 120 parts of acrylic acid dimer, 63 parts of dodecanethiol, and 39 parts of sodium dodecylbenzenesulfonate dissolved in 1,690 parts of ion-exchanged water, and the resulting mixture is emulsified using a homomixer. Following emulsification, gentle stirring is continued using a stirring device fitted with four inclined paddles (the emulsion 2). The air within the system of the emulsion 1 is subjected to thorough replacement with nitrogen, the temperature is then raised to 75° C. under a continuous nitrogen stream, and 600 parts of a 10% aqueous solution of ammonium persulfate (APS) is added. Following subsequent heating for 10 minutes, a pump is used to add the emulsion 2 gradually in a dropwise manner, over a period of 3 hours, via the monomer dropping funnel of the reaction vessel containing the emulsion 1, and the reaction is then continued at 75° C. Following completion of the dropwise addition of the emulsion 2, the reaction is continued for a further 3 hours at 75° C., and the reaction mixture is then cooled, yielding a resin particle dispersion 1 with a particle size of 200 nm and a solid fraction concentration of 41.0%.

The thus obtained resin particles are dried, and measurement of the molecular weight reveals a weight average molecular weight of 32,000 and a number average molecular weight of 11,000. The glass transition temperature of the resin particles is 52° C.

(Preparation of Resin Particle Dispersion 2)

1,000 parts of the resin particle dispersion 1 obtained above are placed in a reactor fitted with an extraction tube (a device that isolates vapor components that are volatilized on heating, and removes those components from the reaction system rather than returning them to the reactor), a stirrer, a nitrogen gas inlet, and a sample supply port, the resin particle dispersion is heated to 90° C., nitrogen gas is introduced into the gas phase from the nitrogen gas inlet at a flow rate of 400 L/min/$m^2$ (namely, per unit of surface area of the gas-liquid interface inside the reactor), and 50% (287.5 parts) of the water within the resin particle dispersion is extracted. This quantity of 50% is determined from the solid fraction concentration of the resin particle dispersion prior to treatment, by assuming that water accounts for everything other than the solid fraction within the dispersion, and then calculating the quantity corresponding with 50% of this total water content. Moreover, for every 3% (17 parts) of water extracted from the system, a fresh sample of ion-exchanged water of equal quantity to the quantity of extracted water is added to the system via the sample supply port, thereby ensuring that the concentration of the resin particle dispersion stays constant throughout the extraction operation, and thereby preventing an increase in the resin particle solid fraction concentration. The resulting resin particle dispersion is termed the resin particle dispersion 2, and evaluation of the dispersion properties reveals a particle size of 200 nm, a solid fraction concentration of 41.0%, a weight average molecular weight of 32,000, a number average molecular weight of 11,000, and a glass transition temperature of 52° C., which are identical with the properties of the resin particle dispersion 1.

(Preparation of Resin Particle Dispersion 3)

With the exception of introducing air instead of nitrogen gas into the system, treatment is conducted in the same manner as the preparation of the resin particle dispersion 2 described above, yielding a resin particle dispersion 3 with a particle size of 200 nm, a solid fraction concentration of 41.2%, a weight average molecular weight of 32,000, a number average molecular weight of 11,000, and a glass transition temperature of 52° C.

(Preparation of Resin Particle Dispersion 4)

With the exceptions of using a 1N aqueous solution of sodium hydroxide to adjust the resin particle dispersion to pH7 prior to extraction, and conducting the extraction while bubbling nitrogen gas through the liquid phase at a flow rate of 40 L/min/$m^2$, treatment is conducted in the same manner as the preparation of the resin particle dispersion 2 described above, yielding a resin particle dispersion 4 with a particle size of 200 nm, a solid fraction concentration of 41.1%, a weight average molecular weight of 32,000, a number average molecular weight of 11,000, and a glass transition temperature of 52° C.

(Preparation of Resin Particle Dispersion 5)

With the exceptions of altering the heating temperature to 75° C., setting the nitrogen gas flow rate at 400 L/min/$m^2$, and reducing the pressure within the reactor to 40 kPa, treatment is conducted in the same manner as the preparation of the resin particle dispersion 2 described above, yielding a resin particle dispersion 5 with a particle size of 200 nm, a solid fraction concentration of 41.0%, a weight average molecular weight of 32,000, a number average molecular weight of 11,000, and a glass transition temperature of 52° C.

(Preparation of Resin Particle Dispersion 6)

With the exceptions of altering the heating temperature to 75° C., setting the nitrogen gas flow rate at 400 L/min/$m^2$, and reducing the pressure within the reactor to 55 kPa, treatment is conducted in the same manner as the preparation of the resin particle dispersion 2 described above, yielding a resin particle dispersion 6 with a particle size of 200 nm, a solid fraction concentration of 41.0%, a weight average molecular weight of 32,000, a number average molecular weight of 11,000, and a glass transition temperature of 52° C.

| (Preparation of Release Agent Fine Particle Dispersion (W1)) | |
|---|---|
| Polyethylene wax (Polywax 725, melting point: 103° C., manufactured by Beker Petrolite Co., Ltd.) | 3,000 parts |
| Sodium dodecylbenzenesulfonate | 30 parts |
| Ion-exchanged water | 6,700 parts |

The above components are heated to 95° C., dispersed thoroughly using a homogenizer (Ultra Turrax T50, manufactured by TKA Works Inc.), and subsequently subjected to further dispersion treatment using a pressure discharge disperser (Gaulin homogenizer, manufactured by Gaulin Co., Inc.), thereby yielding a release agent fine particle dispersion (W1). The number average particle size D50n of the release agent fine particles within the dispersion is 260 nm. Ion-exchanged water is then added to adjust the solid fraction concentration of the dispersion to 30%.

| (Preparation of Pigment Dispersion K) | |
|---|---|
| Carbon black (Regal 330, manufactured by Cabot Corporation) | 2,000 parts |
| Sodium dodecylbenzenesulfonate | 200 parts |
| Ion-exchanged water | 7,800 parts |

The above components were dispersed for approximately 1 hour using a high pressure counter collision type dispersing machine (Ultimaizer HJP30006, manufactured by Sugino Machine Ltd.), thus yielding a black pigment dispersion. The average particle size of the dispersed pigment is 150 nm. Ion-exchanged water is then added to adjust the solid fraction concentration of the dispersion to 20%.

Comparative Example 1

Preparation of Toner Particles 1

495 parts of the resin particle dispersion (1) obtained by polymerizing the radical polymerizable monomers described above, 116 parts of the above pigment dispersion K, 104 parts of the release agent fine particle dispersion (W1), and 1,180 parts of ion-exchanged water are placed in a SUS vessel, and then dispersed and mixed for 15 minutes in an Ultra Turrax by applying a shearing force at 8,000 rpm. Subsequently, 30 parts of a 10% nitric acid aqueous solution of polyaluminum chloride are added gradually in a dropwise manner as a coagulant. The pH of the raw material dispersion is adjusted to a value within a range from 2.8 to 3.2 using a 0.1M aqueous solution of sodium hydroxide and a 0.1M aqueous solution of nitric acid.

Subsequently, a stainless steel polymerization tank fitted with a stirring device and a thermometer is charged with the raw material dispersion, and under constant stirring, the resin particles, the pigment particles and the wax particles are gradually heated and aggregated to adjust the volume average particle size (measured using a Coulter Multisizer-II (manufactured by Beckman Coulter, Inc., aperture size: 50 μm) to 5.0 μm. Subsequently, a further 240 parts of the resin particle dispersion (1) are added dropwise, and following adjustment of the particle size to 6.0 μm at 55° C., a 1M aqueous solution of sodium hydroxide is added to raise the pH to 7.0, the temperature is raised to 95° C., and this temperature is maintained for 3 hours, thus yielding potato-shaped toner particles with a volume average particle size of 6.0 μm and a volume average particle size distribution index (GSDv) of 1.21. Subsequently, the dispersion is cooled, filtered through a 45 μm mesh, washed thoroughly and repeatedly with water, and then dried using a flash jet dryer (manufactured by Seishin Enterprise Co., Ltd.) until the water content reaches 0.5%, thus yielding toner particles 1.

(Measurement of VOC Gas Using Gas Chromatography)

Using a gas chromatography mass spectrophotometer (GCMS-QP2010, manufactured by Shimadzu Corporation) fitted with a head space sampler (TurboMatrix HS, manufactured by PerkinElmer Inc.), the volatile VOC gases are measured under the following conditions, and the surface area is quantified for each gas.

Measurement of Toluene Quantity from Saturated Aqueous Solution of Toluene Used for Surface Area Correction:

10 g of water and 10 g of toluene are mixed together for 8 hours at 25° C., and the water phase is then removed, yielding a saturated aqueous solution of toluene (the saturation solubility of toluene in water at 25° C. is 5.63 mmol/L). This saturated solution is diluted 100-fold, 2 g of the diluted solution is heated at 60° C. for 90 minutes, and a sample in a state of vapor-liquid equilibrium is then injected via the head space sampler and subjected to GCMS analysis (column: Rtx-1, length: 60 m, film thickness: 1.0 μm, internal diameter: 0.32 mm, column oven: 40° C., vaporization chamber temperature: 150° C., mass spectrum ion source temperature: 200° C., interface temperature: 250° C., detector voltage: 0.8 kV).

Following completion of this measurement, the same sample (the sample within the head space) is used to repeat the above measurement operation 5 times, and calculation of the toluene quantity per unit of surface area from the relationship between the number of extractions and the value of the measured surface area reveals a value of $2.5\times10^{-12}$ (a MHE method).

Measurement of VOC in Toner Particles 1:

50 mg of the toner particles 1 are inserted into the above head space sampler, the gas generated upon heating the particles for 3 minutes at 130° C. is injected into the above gas chromatograph, and GCMS analysis is conducted in the same manner as described above.

From the thus obtained gas chromatograph/mass spectrum, the surface areas are determined for the peaks corresponding with 1-butanol, ethylbenzene, n-butyl ether, styrene, butyl propionate, cumene, benzaldehyde and propylbenzene, and the formulas 1 and 2 described above in the detailed description are used to determine the values of Z1 and Z2 (see Table 1). Furthermore, the spatial coordinates are shown in FIG. 1.

(Preparation and Evaluation of Developer 1)

To 100 parts of the toner particles 1 is added 1 part of colloidal silica (R972, manufactured by Nippon Aerosil Co., Ltd.) as an external additive, and the resulting mixture is blended in a Henschel mixer, yielding an electrostatic latent image developing toner. Moreover, 100 parts of ferrite particles (manufactured by Powder Tech Co., Ltd., volume average particle size: 50 μm) and 1 part of a methyl methacrylate resin (manufactured by Mitsubishi Rayon Co., Ltd., molecular weight: 95,000) are combined with 500 parts of toluene in a pressurized kneader, and following mixing for 15 minutes at ambient temperature, the temperature is raised to 70° C. while mixing is continued under reduced pressure. Following removal of the toluene by distillation, the mixture is cooled, and classified using a 105 μm sieve, thus yielding a ferrite carrier (a resin-coated carrier). This ferrite carrier and the above electrostatic latent image developing toner are mixed together, yielding a two-component electrostatic latent image developer with a toner concentration of 7% by weight.

Evaluation of Volatile VOC from Machine

A modified DocuCentre af235G apparatus manufactured by Fuji Xerox Co., Ltd. is placed inside a sealed constant temperature and humidity stress testing chamber of dimensions 3 m×3 m×2 m (with internal air circulation, 28° C., 80% RH), and using this apparatus, the above developer 1 is used to print 5,000 continuous copies (with a coverage of 20%) onto V602 A4 PPC paper manufactured by Fuji Xerox Co., Ltd., and when the odor inside the chamber is then evaluated by 15 male and 15 female panelists (a total of 30 people) against the criteria shown below, more than half of the panelists detect the odor, and report a strong degree of unpleasantness (see Table 1).

A: At least 27 of the 30 panelists detect almost no odor.

B: At least 24 of the 30 panelists detect almost no odor.

C: At least 21 of the 30 panelists detect almost no odor.

D: At least 10 of the panelists detect an odor, and report the odor as unpleasant.

In order to provide the panelists with a standard against which to evaluate a "faint odor", each panelist was asked to smell an olfactory measurement standard odor prior to testing, prepared by impregnating a sheet of filter paper of dimensions 1 cm×3 cm with $B10^{-4.5}$ (manufactured by Daiichi Yakuhin Sangyo Co., Ltd., equivalent to a sensory level described as a "slight smell"), and odors that are less detectable than this standard odor are evaluated as "A", whereas odors of a similar level are described as having a "faint odor".

Example 1

Preparation of Toner Particles 2

With the exception of using the resin particle dispersion 2 instead of the resin particle dispersion 1 used in the preparation of the toner particles 1 of the above comparative example 1, toner particles 2 are prepared in the same manner as the comparative example 1. Furthermore, VOC gas measurement by gas chromatography is also conducted in the same manner as the comparative example 1, and the results are shown in Table 1. Moreover, the spatial coordinates are shown in FIG. 1.

(Preparation and Evaluation of Developer 2)

With the exception of using the toner particles 2 instead of the toner particles 1 used in the preparation of the developer 1 of the above comparative example 1, a developer 2 is prepared in the same manner as the comparative example 1. Furthermore, measurement of the VOC gas from a machine using the developer 2 is also conducted in the same manner as the comparative example 1, and the results are shown in Table 1.

Example 2

Preparation of Toner Particles 3

With the exception of using the resin particle dispersion 3 instead of the resin particle dispersion 1 used in the preparation of the toner particles 1 of the above comparative example 1, toner particles 3 are prepared in the same manner as the comparative example 1. Furthermore, VOC gas measurement by gas chromatography is also conducted in the same manner as the comparative example 1, and the results are shown in Table 1. Moreover, the spatial coordinates are shown in FIG. 1.

(Preparation and Evaluation of Developer 3)

With the exception of using the toner particles 3 instead of the toner particles 1 used in the preparation of the developer 1 of the above comparative example 1, a developer 3 is prepared in the same manner as the comparative example 1. Furthermore, measurement of the VOC gas from a machine using the developer 3 is also conducted in the same manner as the comparative example 1, and the results are shown in Table 1.

Example 3

Preparation of Toner Particles 4

With the exception of using the resin particle dispersion 4 instead of the resin particle dispersion 1 used in the preparation of the toner particles 1 of the above comparative example 1, toner particles 4 are prepared in the same manner as the comparative example 1. Furthermore, VOC gas measurement by gas chromatography is also conducted in the same manner as the comparative example 1, and the results are shown in Table 1. Moreover, the spatial coordinates are shown in FIG. 1.

(Preparation and Evaluation of Developer 4)

With the exception of using the toner particles 4 instead of the toner particles 1 used in the preparation of the developer 1 of the above comparative example 1, a developer 4 is prepared in the same manner as the comparative example 1. Furthermore, measurement of the VOC gas from a machine using the developer 4 is also conducted in the same manner as the comparative example 1, and the results are shown in Table 1.

Example 4

Preparation of Toner Particles 5

With the exception of using the resin particle dispersion 5 instead of the resin particle dispersion 1 used in the preparation of the toner particles 1 of the above comparative example 1, toner particles 5 are prepared in the same manner as the comparative example 1. Furthermore, VOC gas measurement by gas chromatography is also conducted in the same manner as the comparative example 1, and the results are shown in Table 1. Moreover, the spatial coordinates are shown in FIG. 1.

(Preparation and Evaluation of Developer 5)

With the exception of using the toner particles 5 instead of the toner particles 1 used in the preparation of the developer 1 of the above comparative example 1, developer 5 is prepared in the same manner as the comparative example 1. Furthermore, measurement of the VOC gas from a machine using the developer 5 is also conducted in the same manner as the comparative example 1, and the results are shown in Table 1.

Example 5

Preparation of Toner Particles 6

With the exception of using the resin particle dispersion 6 instead of the resin particle dispersion 1 used in the preparation of the toner particles 1 of the above comparative example 1, toner particles 6 are prepared in the same manner as the comparative example 1. Furthermore, VOC gas measurement by gas chromatography is also conducted in the same manner as the comparative example 1, and the results are shown in Table 1. Moreover, the spatial coordinates are shown in FIG. 1.

(Preparation and Evaluation of Developer 6)

With the exception of using the toner particles 6 instead of the toner particles 1 used in the preparation of the developer 1 of the above comparative example 1, a developer 6 is prepared in the same manner as the comparative example 1. Furthermore, measurement of the VOC gas from a machine using the developer 6 is also conducted in the same manner as the comparative example 1, and the results are shown in Table 1.

TABLE 1

Values of Z1 and Z2 for volatile VOC from toner particles, and results of evaluating odor emanating from a machine

| | | Comparative example 1 | Example 1 | Example 2 | Example 3 | Example 4 | Example 5 |
|---|---|---|---|---|---|---|---|
| Gas chromatography surface area (following correction) | 1-butanol | 108,662 | 83,596 | 54,780 | 77,847 | 78,486 | 77,000 |
| | ethylbenzene | 529,852 | 378,988 | 222,179 | 265,977 | 168,978 | 422,000 |
| | n-butyl ether | 208,362 | 110,261 | 114,694 | 215,449 | 100,260 | 102,230 |
| | styrene | 390,839 | 508,650 | 379,150 | 415,434 | 498,650 | 499,000 |
| | butyl propionate | 15,125 | 0 | 13,935 | 0 | 0 | 0 |
| | cumene | 2,348,342 | 496,161 | 766,425 | 2,422,613 | 476,162 | 481,000 |
| | benzaldehyde | 731,598 | 527,556 | 430,402 | 660,878 | 427,557 | 432,000 |
| | propylbenzene | 519,078 | 212,446 | 269,713 | 479,591 | 212,446 | 215,520 |
| Z1 | | 0.6 | −1.2 | −1.0 | −0.1 | −1.5 | −1.2 |
| Z2 | | 1.1 | 0.6 | −0.4 | 0.5 | −0.3 | 0.9 |
| Volatility from Machine | | D | B | A | B | A | B |
| Evaluation of VOC odor | | At least half of the panelists readily detect the odor, and report unpleasantness | Faint odor, but not unpleasant and not problematic | Almost no odor detected | Faint odor, but not unpleasant and not problematic | Almost no odor detected | Faint odor, but not unpleasant and not problematic |

From the above results it is evident that in the examples 1 to 5, by reducing the quantity of volatile VOC within the toner and ensuring that $Z1 \leqq 0$ and $Z2 \leqq 0.9$, the unpleasant odor that emanates from the electrophotographic machine during operation can be reduced, enabling the operating environment within an enclosed space to be improved dramatically. Furthermore, the lower the values of Z1 and Z2 become, the greater the improvement in the operating environment.

An electrostatic latent image developing toner of the present invention is particularly useful within applications such as electrophotographic methods and electrostatic recording methods.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method of producing an electrostatic latent image developing toner, comprising:

preparing a resin particle dispersion by polymerizing, in a water-based solvent, a polymerizable monomer that comprises a polymerizable monomer comprising a vinyl-based double bond;

excluding an azeotrope evaporated from the resin particle dispersion by heating and adding a quantity of fresh water to the resin particle dispersion that is equal to a quantity of vapor in the excluded azeotrope;

mixing the distilled resin particle dispersion with a colorant particle dispersion prepared by dispersing colorant to form a mixture comprising resin particles and colorant particles; and aggregating the resin particles, the colorant particles, and release agent particles to form aggregate particles, and then conducting heating to fuse the aggregate particles.

2. The method of producing an electrostatic latent image developing toner according to claim 1, wherein the excluding the azeotrope evaporated from the resin particle dispersion comprises the conducting the exclusion while introducing a gas.

3. The method of producing an electrostatic latent image developing toner according to claim 1, wherein the excluding the azeotrope evaporated from the resin particle dispersion comprises conducting the exclusion under reduced pressure.

4. The method of producing an electrostatic latent image developing toner according to claim 2, wherein the excluding the azeotrope evaporated from the resin particle dispersion comprises conducting the exclusion under reduced pressure.

5. The method of producing an electrostatic latent image developing toner according to claim 1, wherein the excluding the azeotrope evaporated from the resin particle dispersion comprises conducting the exclusion while bubbling gas through the liquid phase of the resin particle dispersion.

6. The method of producing an electrostatic latent image developing toner according to claim 3, wherein the excluding the azeotrope evaporated from the resin particle dispersion comprises conducting the exclusion while bubbling gas through the liquid phase of the resin particle dispersion.

7. The method of producing an electrostatic latent image developing toner according to claim 1, wherein the mixing of the distilled resin particle dispersion with the colorant particle dispersion further includes mixing with a release agent particle dispersion prepared by dispersing a release agent.

8. The method of producing an electrostatic latent image developing toner according to claim 5, wherein a flow rate of the bubbling gas through the liquid phase of the resin particle dispersion is within a range from 40 to 600 $L/min/m^2$.

9. The method of producing an electrostatic latent image developing toner according to claim 6, wherein the flow rate of the bubbling gas through the liquid phase of the resin particle dispersion is within the range of from 40 to 600 $L/min/m^2$.

10. The method of producing an electrostatic latent image developing toner according to claim 5, wherein the flow rate of the bubbling gas through the liquid phase of the resin particle dispersion is within the range of from 100 to 400 $L/min/m^2$.

11. The method of producing an electrostatic latent image developing toner according to claim 6, wherein the flow rate of the bubbling gas through the liquid phase of the resin particle dispersion is within the range of from 100 to 400 $L/min/m^2$.

12. The method of producing an electrostatic latent image developing toner according to claim 3, wherein the condition of reduced pressure is controlled within a range bounded by the vapor pressure of water at the particular treatment temperature and a pressure 20 kPa higher than said vapor pressure.

13. The method of producing an electrostatic latent image developing toner according to claim 1, wherein, if surface area values for 1-butanol, ethylbenzene, n-butyl ether, styrene, butyl propionate, cumene, benzaldehyde and propylbenzene obtained from gas chromatographic analysis of volatile gas components generated upon heating the toner are termed, a, b, c, d, e, f, g and h respectively, then Z1 and Z2 satisfy formulas 1 shown below:

(Formulas 1)

$$Z1 = 5.2 \times 10^{-5}a + 9.6 \times 10^{-7}b + 2.7 \times 10^{-6}c - 2.5 \times 10^{-6}d + 8.7 \times 10^{-6}e + 1.5 \times 10^{-7}f + 1.1 \times 10^{-6}g + 8.3 \times 10^{-7}h - 1.81$$

$$Z2 = -6.9 \times 10^{-6}a + 4.6 \times 10^{-6}b - 3.9 \times 10^{-7}c + 2.5 \times 10^{-6}d - 2.1 \times 10^{-5}e + 2.3 \times 10^{-7}f - 6.8 \times 10^{-7}g + 1.2 \times 10^{-6}h - 1.82$$

$$Z1 \leqq 0, \text{ and } Z2 \leqq 0.9.$$

14. The method of producing an electrostatic latent image developing toner according to claim 1, wherein the polymerizable monomer comprising a vinyl-based double bond comprises at least one polymerizable monomer selected from styrene, methacrylate ester, and acrylate ester.

15. The method of producing an electrostatic latent image developing toner according to claim 1, wherein the polymerizable monomer comprising a vinyl-based double bond consists of styrene and butyl acrylate.

* * * * *